US006663206B2

(12) United States Patent
Taylor

(10) Patent No.: US 6,663,206 B2
(45) Date of Patent: Dec. 16, 2003

(54) SYSTEMS AND METHOD FOR MASKING STITCH ERRORS

(75) Inventor: Thomas N. Taylor, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 183 days.

(21) Appl. No.: 09/683,549

(22) Filed: Jan. 16, 2002

(65) Prior Publication Data

US 2003/0132979 A1 Jul. 17, 2003

(51) Int. Cl.[7] ..... B41J 29/38

(52) U.S. Cl. ..... 347/9; 347/12; 347/13; 358/1.5

(58) Field of Search ..... 358/488, 1.5, FOR 146; 347/5, 9, 12, 13, 40, 41, 42, 19

(56) References Cited

U.S. PATENT DOCUMENTS 5,394,223 A * 2/1995 Hart et al. ..... 399/165
6,155,669 A 12/2000 Donahue et al.
6,547,370 B2 * 4/2003 Mantell et al. ..... 347/41

OTHER PUBLICATIONS

U.S. patent application Ser. No. 09/692,336, Martin Hoover, filed Oct. 2000.

* cited by examiner

*Primary Examiner*—Huan Tran
(74) *Attorney, Agent, or Firm*—Oliff & Berridge, PLC

(57) ABSTRACT

It is desirable to cover up or mask the stitch joint error. This invention provides systems and methods for indexing the position of a sheet of recording medium conventionally and then measuring the position of the sheet of recording medium accurately by a sensor. Data in the printhead is shifted so that the data is accurately aligned within a predetermined pixel accuracy to the known paper position. This invention covers up the resulting stitch joint error by modifying the pixels at the stitch joint interface to mask the apparent error.

34 Claims, 9 Drawing Sheets

SYSTEMS AND METHOD FOR MASKING STITCH ERRORS

BACKGROUND OF THE INVENTION

1. Field of Invention

The invention relates to masking stitch errors between swaths during printing.

2. Description of Related Art

Fluid ejecting devices such as, for example, inkjet printers, fire drops of fluid from rows of nozzles of an ejection head. The nozzles are usually fired sequentially in groups beginning at one end of the head and continuing to the other end of the head. While the nozzles are being fired, the head moves at a rate designed to advance it by a resolution distance before the next firing sequence begins. If the nozzles are not fired simultaneously, the rows of nozzles can be tilted so that drops fired from all nozzles land in a substantially vertical column.

The ejection head can have one or more dies, each die having a plurality of nozzles. Some devices have ejection heads with only one die, and some devices have ejection heads with multiple dies. If an ejection head has multiple dies, the dies can be, for example, arranged vertically with respect to one another so that the head can eject more drops in a single swath of the head compared to a head having a single die.

The line at which the swaths ejected by adjacent dies meet, or at which the adjacent swaths meet, is called the stitch joint. Stitch joint errors occur when the swaths meeting at the stitch joint meet in such a way that the resulting arrangement of drops at one side of the stitch joint of a printed image are displaced from the drops on the other side of the stitch joint by a different distance than the displacement distance between drops within a swath. This creates a visible, undesirable print defect. Because of the spacing of the stitch joint errors, the stitch joint errors are very noticeable because the human eye is very sensitive to this spatial frequency region.

Stitch joint error can be, for example, the result of a gap between the drop of one die or swath adjacent the stitch joint and the drop of an adjoining swath or die adjacent the stitch joint. The gap is usually caused by difficulties in producing adjacent swaths close enough together to mask this apparent error.

SUMMARY OF THE INVENTION

It is desirable to cover up or mask the stitch joint error. Prior art techniques for masking the stitch error between swaths require alternating the firing of the nozzles of adjacent dies in a multi-die ejection head using different firing sequences. However, it is often difficult to precisely position adjacent dies so that the spacing between the lowermost nozzle of the upper swath and the uppermost nozzle of the lower swath is reduced enough so that the stitch joint error becomes less apparent.

This invention provides systems and methods for indexing the position of a sheet of recording medium conventionally and then measuring the position of the sheet of recording medium accurately by a sensor.

This invention separately provides systems and methods for shifting the data in the printhead so that the data is accurately aligned within a predetermined pixel accuracy to the known paper position.

This invention separately provides systems and methods for shifting the position of the printhead so that the data is accurately aligned within a predetermined pixel accuracy to the known paper position.

This invention separately provides systems and methods for covering up the resulting stitch joint error by modifying the pixels at the stitch joint interface to mask the apparent error.

In various exemplary embodiments of the systems and methods of this invention, a sheet of recording medium is indexed crudely. The resulting position is measured more accurately using a sensor. The sensor provides this information to a controller. In various exemplary embodiments, the systems and methods of this invention shift the data in the printhead so that the data is aligned within a predetermined pixel accuracy to the measured paper position. In various exemplary embodiments, the remaining sub-pixel stitch joint error is covered up by modifying the pixels at the stitch interface.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the invention will be described in relation to the following drawings, in which like reference numerals refer to like elements, and wherein.

DETAILED DESCRIPTION OF THE EXEMPLARY EMBODIMENTS

Figure 1:
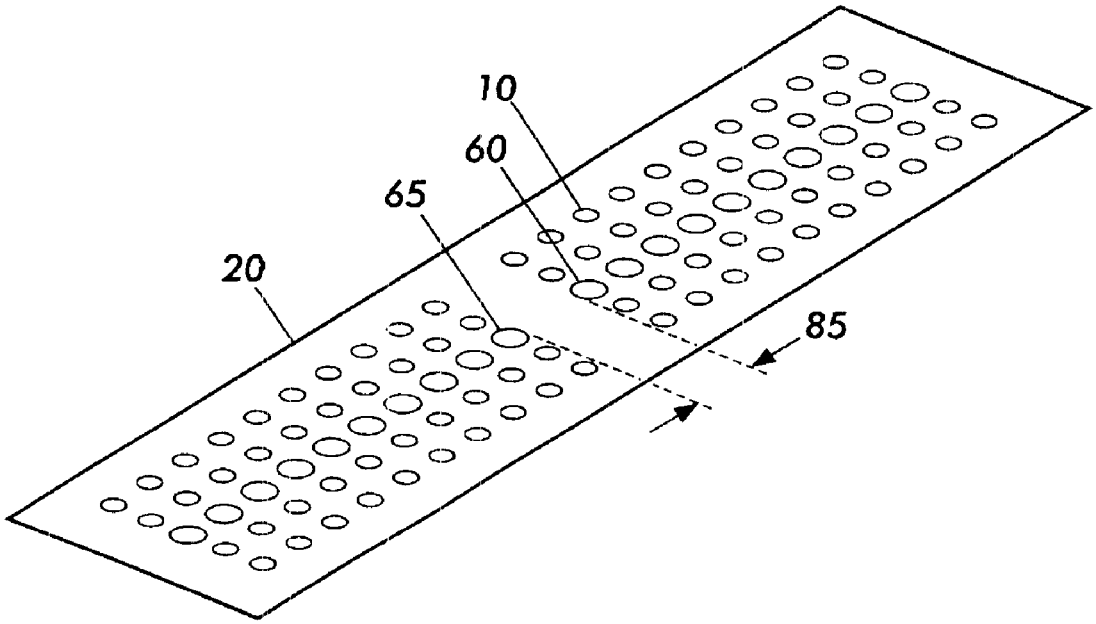
FIG. 1 shows a stitch joint error between two swaths.

The following detailed description of various exemplary embodiments of the fluid ejection systems according to this invention are directed to one specific type of fluid ejection system, an ink jet printer, for sake of clarity and familiarity. However, it should be appreciated that the principles of this invention, as outlined and/or discussed below, can be equally applied to any known or later developed fluid ejection systems, beyond the ink jet printer specifically discussed herein.

Fluid ejector systems, such as drop-on-demand liquid ink printers, such as piezoelectric, acoustic, phase-change wax-based or thermal type printers, have at least one fluid ejector from which droplets of fluid are ejected towards a receiving sheet. Within the fluid ejector, the fluid is contained in a plurality of channels. Power pulses cause the droplets of fluid to be expelled as required from orifices or nozzles at the end of the channels.

When the fluid ejector is an ink jet printhead, the fluid ejector may be incorporated into, for example, a carriage-type printer, a partial-width array-type printer, or a page-width-type printer. The carriage-type printer typically has a relatively small printhead containing the ink channels and nozzles. The printhead can be sealingly attached to a disposable ink supply cartridge. The combined printhead and cartridge assembly is attached to a carriage that is reciprocated to print one swath of information at a time, on a stationary receiving medium, such as paper or a transparency, where each swath of information is equal to the length of a column of nozzles.

After the swath is printed, the receiving medium is stepped a distance at most equal to the height of the printed swath so that the next printed swath is contiguous or overlaps with the previously printed swath. This procedure is repeated until the entire image is printed.

In contrast, the page-width printer includes a stationary printhead having a length sufficient to print across the width or length of the sheet of receiving medium. The receiving medium is continually moved past the page-width printhead in a direction substantially normal to the printhead length and at a constant or varying speed during the printing process. A page width fluid ejector printer is described, for instance, in U.S. Pat. No. 5,192,959, incorporated herein by reference in its entirety.

Fluid ejection systems typically eject fluid drops based on information received from an information output device, such as a personal computer. Typically, this received information is in the form of a raster, such as, for example a full page bitmap or in the form of an image written in a page description language. The raster includes a series of scan lines comprising bits representing individual information elements. Each scan line contains information sufficient to eject a single line of fluid droplets across the receiving medium in a linear fashion. For example, fluid ejection printers can print bitmap information as received or can print an image written in the page description language once it is converted to a bitmap of pixel information.

FIG. 1 shows the systematic stitch joint error between a pixel discharged or fired from a last nozzle of a first swath and a pixel discharged or fired from the first nozzle of an adjacent or subsequent swath. The gap between the printed pixels 60 of a first swath 1 and the black pixels 65 of a second swath 2 is the stitch joint error 85. The stitch joint error 85 is caused, for example, by mispositioning of the recording media or the ejection head between swaths.

This mispositioning of the last pixel in the first swath 1 and the first pixel of the second swath 2 usually arises due to errors resulting from manufacturing tolerances and limitations. As the swath width of a fluid ejection system becomes larger, the difficulty in having the proper position of the fluid receiving substrate for adjacent swaths increases. Thus, it is difficult to position the fluid receiving substrate accurately to within an acceptable margin, which is usually about 10 $\mu$m but which can be even smaller.

Figure 2:
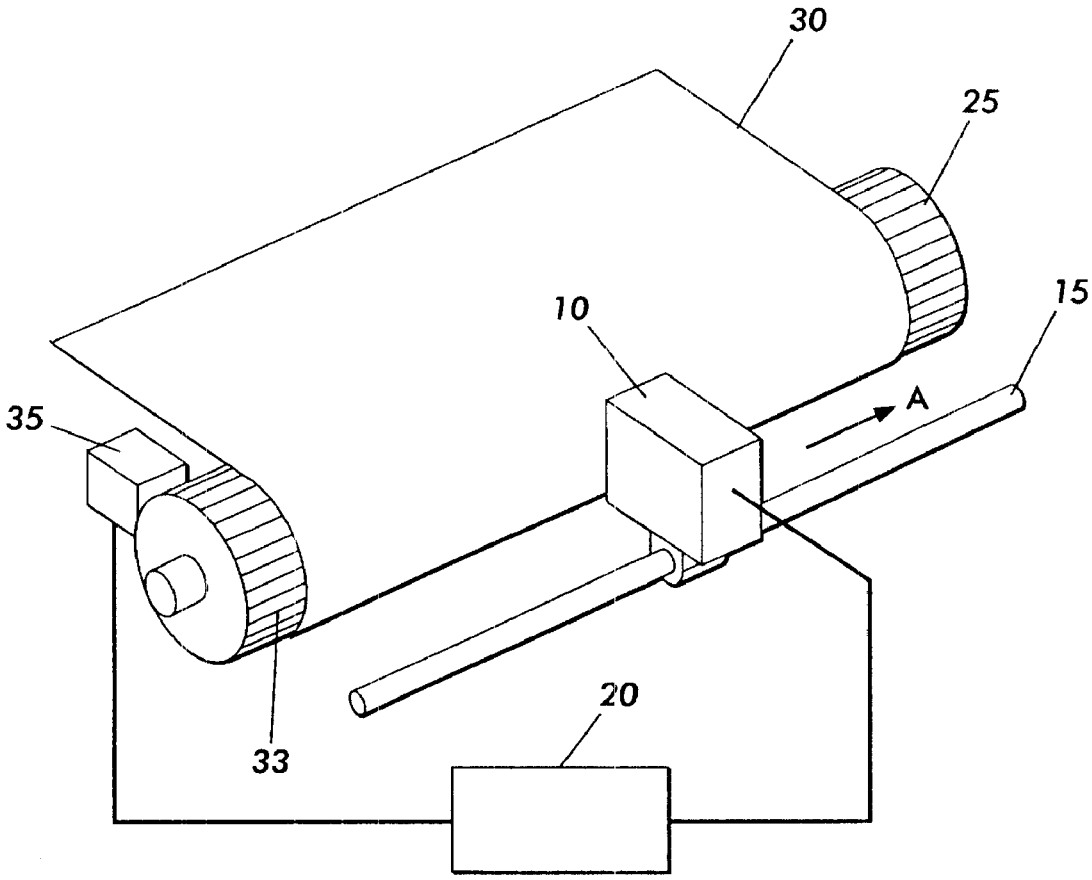
FIG. 2 is a perspective view of an exemplary image recording apparatus in which the systems and methods of the invention can be used.

FIG. 2 shows a portion of a fluid ejecting apparatus that incorporates the systems and methods of the invention. As shown in FIG. 2, a fluid ejection head 10 moves in a first direction A along a guide rod 15. It should be appreciated that the fluid ejection head 10 is movable along the guide rod 15 in a first direction and a second direction opposite the first direction.

A receiving substrate 30 is supported by a platen 25. As the fluid ejection head 10 moves back and forth along the guide rod 15, an image is created on the receiving substrate 30. The receiving substrate 30 is typically in a flat position when it receives the created image as the fluid ejection head 10 moves back and forth along the guide rod 15. However, it should be appreciated that the receiving substrate 30 can be in any position suitable to adequately receive the created image from the fluid ejection head 10. The fluid ejection apparatus shown in FIG. 2 includes a sensor 35 connected to a controller 20. The sensor 35 detects marks 33 located on the platen 25. In particular, the sensor 35 detects the marks 33 to detect an amount of rotation of the platen 25.

The information detected by the sensor 35, concerning the amount of rotation of the platen 25, is output to the controller 20. The controller 20 uses the information provided by the sensor 35 to determine the amount of movement of the fluid receiving substrate 30 relative to the fluid ejection head 10. Accordingly, the position of the fluid receiving substrate is determined by the controller 20.

In various exemplary embodiments, the sensor 35 can be implemented using any one of a number of sensors that accurately sense the position of a moving surface having a primary movement direction, where the moving surface is marked with a plurality of detectable marks.

For ease of understanding and clarity, the following description of the systems and methods of this invention are directed to a specific type of sensor, a bi-directional linear incremental position sensor, or BLIP sensor, that is usable to accurately measure the position of the fluid receiving substrate 30 relative to the fluid ejection head 10. However, it should be appreciated that the systems and methods of this invention can use any type of sensor that is usable to accurately measure the position of the fluid receiving substrate 30 relative to the fluid ejection head.

As indicated above, while any suitable type of sensor can be used with the systems and methods of this invention, the following description will focus on a bi-directional linear incremental position sensor. In general, the bi-directional linear incremental position sensor has sharp edge detection quality. Conventionally, an optical sensor in an ink jet printer sequentially detects a linear array of transverse belt timing marks, such as the marks 33 discussed above. Accurately sensing the position of the sheet being printed by an inkjet printer can provide improved quality printing and reduce the stitch joint error.

It should be appreciated that the individual detected lines of a mark may be much thicker than the pixel spacing of the linear array detector marks sensor. For example, a typical detectable mark line could be 200 or more pixels wide and the inter pixel spacing of a 2000 pixel array could be only 10 microns or less. While the mark thickness is not critical with the bi-directional linear incremental position sensor 35, a sharp edge detection quality of the marks is desirable.

In particular, the bi-directional linear incremental position sensor 35 is used to detect the marks 33 spaced together around the circumference of the platen 25. The marks 33 are spaced incrementally around the platen 25. It should be appreciated that the marks 33 can be spaced in any manner as long as they are detectable by the sensor 35.

When the platen 25 rotates, the bi-directional linear incremental position sensor 35 detects the marks 33 as they pass by the bi-directional linear incremental position sensor 35 and the corresponding position of each individual timing mark 33 on the platen 25.

The bi-directional linear incremental position sensor 35 detects the movement of each individual mark 33 relative to the last mark 33 that was detected. By detecting the motion of the marks 33, the bi-directional linear incremental position sensor 35 detects the positional change of the fluid receiving substrate 30. That is, the marks 33 provide movement information to the bi-directional linear incremental position sensor 35. The bi-directional linear incremental position sensor 35 converts this position information into a signal that is output to the controller 20. Thus, the bi-directional linear incremental position sensor 35 provides highly accurate information of the position of the fluid recording medium relative to the fluid ejection head 10.

The last nozzle of the uppermost swath and the first nozzle of the lowermost adjacent swath are desirable precisely aligned such that the lowermost nozzle of the first swath and the uppermost nozzle of the second swath are spaced correctly to produce an image without any resulting stitch joint error. However, as discussed above, when nozzles of the first and second swath are not spaced correctly, a stitch joint error results.

Thus, the systems and methods of this invention reduce stitch joint error by shifting the data in the printhead 10 to reduce stitch joint error. Shifting data in the printhead 10 allows a nozzle, which was not necessarily originally designated to fire the pixel data prior to the shift of data, to fire pixel data. Shifting the data in the printhead 10 allows the resulting swaths on the fluid recording medium to be aligned such that an apparent stitch joint error is reduced or eliminated.

Shifting of data in the printhead 10 occurs after the controller 20 receives the positional information of the fluid recording medium detected by the sensor 35. In response, the controller 20 controls which nozzles in the printhead 10 receive which raster line of data for the next swath. In this manner, the controller 20 controls the printing of the image by the printhead 10.

According to various exemplary embodiments of the systems and methods of this invention, the position of the nozzles of the second swath which are to be fired is determined from the marks 33 and the sensor 35 as described above. In various exemplary embodiments of the systems and methods of this invention, when the controller 20 determines that a stitch joint error will occur based on the current relative location between the printhead 10 and the image receiving medium 30 and the location of the previous swath on the image receiving medium 30, the location of the second swath, and corresponding nozzles which fire the pixel data of the second swath, are adjusted relative to the position of the first swath.

Thus, the image data is shifted in the printhead 10, resulting in the lines of pixel data being fired from nozzles to which the lines of pixel data would not have been originally designated. It should be appreciated that the data for any given raster line of the second swath can be shifted to fire from any nozzle in the array. Shifting the data in the printhead 10 for the second swath moves the fired lines of pixel data relatively closer to the position on the image receiving medium of the first swath. As such, the stitch joint error will be reduced.

Accordingly, the controller 20 utilizes the information about the relative position of the fluid recording medium and the printhead provided by the sensor 35 to determine which nozzle of the second swath 2 will be most accurately positioned adjacent the last fired nozzle of the first swath 1 so that the stitch joint error is reduced to at most 0.5 pixel. Once the controller 35 determines which nozzle of the second swath 2 should be fired first, the data in the printhead is shifted accordingly.

According to another exemplary embodiment of the invention, after the controller 20 receives information about the relative position of the fluid recording medium 30, the printhead can be shifted relative the fluid recording medium so that a nozzle of the second swath 2 will be most accurately positioned adjacent the last fired nozzle of the first swath 1 so that the stitch joint error is reduced to at most 0.5 pixels.

Figure 3:
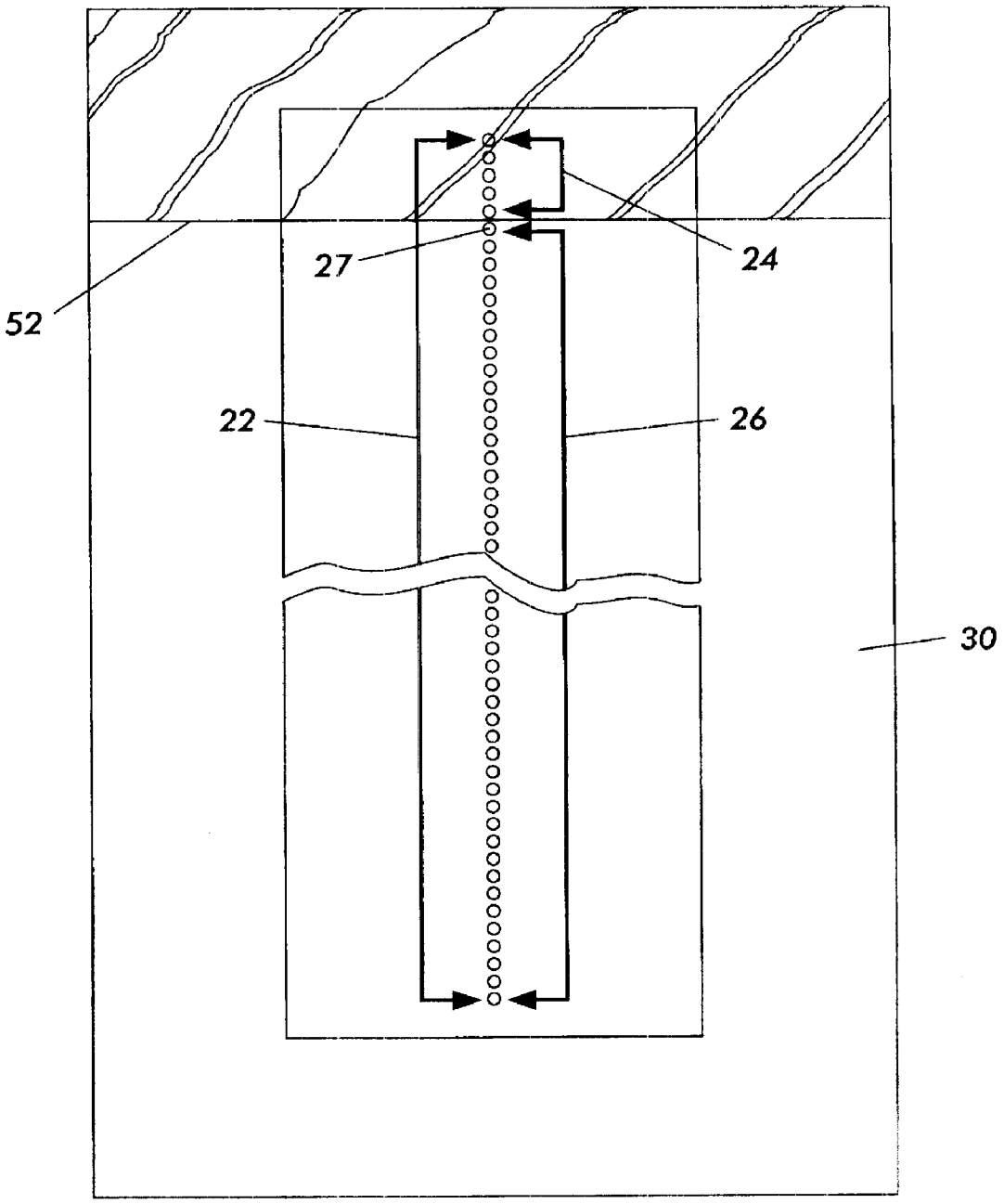
FIG. 3 shows a first exemplary embodiment of pixel data fired from the next swath.

FIG. 3 shows the extent of the printed information from a first swath 52. The bottom of the first swath 52 corresponding to the position of the last raster line and last pixels fired from the nozzles of the first swath. FIG. 3 also shows the relative position of the printhead and corresponding nozzles of the printhead of the second swath after the sheet of fluid recording medium 30 has been advanced. According to the various exemplary embodiments of this invention, the controller 35, shown in FIG. 8, determines the location of the bottom of the first swath 52 and where that location is positioned relative the nozzles of the second swath. With this determination, the controller 35 shifts the data in the printhead with regard to the second swath so that the appropriate nozzles of the second swath are fired which, as discussed in more detail below, reduces minimizes or prevents stitch joint error.

In shifting the data in the printhead with regard to the second swath, the position of the image data is shifted relative to the ejection nozzles in the printhead so that a nozzle, other than the nozzle originally designated to fire the corresponding line of pixel data of the second swath, will be fired. That is, for example, if the first nozzle of the second swath was originally designated to fire a corresponding first line of pixel data, according to exemplary embodiments of this invention, a nozzle other than the first nozzle of the second swath is used to fire the first line of pixels in the second swath. Thus, a nozzle firing the corresponding line of pixels other than that first nozzle of the second swath is selected by the controller 20 as the uppermost firing nozzle of the second swath. In other words, the uppermost one or more nozzles of the second swath may not be used to print image data.

It should be understood that at least one nozzle of the second swath should overlap the pixels fired from the last raster line of the previous swath, wherein the overlapping at least one nozzle does not print image data. Such overlapping avoids the requirement for costly precision assembly that would normally be required to prevent stitch joint error, because misalignment between the two swaths can be limited to at most approximately one-half of the center-to-center nozzle spacing by selecting the appropriate uppermost firing nozzle for printing the second swath. If there is no overlapping of nozzles, there cannot be a shifting of the data in the printhead to reduce or eliminate the stitch joint error. This situation results in an unmaskable stitch joint error.

For example, FIG. 3 shows an exemplary situation in which the number of nozzles which will fire the pixel data is a nominal set of nozzles 22 and where every nozzle has been designated to fire pixel data. The nozzles of the second swath that overlap with the printed image data of the first swath do not print image data. Because of the overlap, the second swath will only fire pixel data from the actual number of nozzles 26 used in the second swath. Thus, the amount of pixel data printed by the second swath will be less than originally planned. However, according to the exemplary embodiments of FIG. 3, the pixel data corresponding to the number of nozzles overlapped 24, will be shifted to the next swath and printed in that next swath.

In FIG. 3, if the controller 35 determines that the sixth nozzle 27 should fire the first line of pixels of the second swath to be printed, the pixel data is shifted so that the sixth nozzle 27 fires the pixel data originally set to be fired by the first nozzle. The data remaining to be fired in subsequent nozzles, i.e. nozzles 26 other than the sixth nozzle 27, is shifted and fired accordingly. As a result of firing the first pixel from the sixth nozzle 27, the number of lines printed in the swath will be less than the number of nozzles. The number of lines printed will be reduced by the number of nozzles 24 overlapped at the top of the second swath. In FIG. 3, the first 5 nozzles 24 will not fire pixel data, and thus the number of lines of printed pixel data of the second swath will be less than originally planned.

According to the exemplary embodiment of FIG. 3, the bottom of the first swath is located in a position between the fifth and sixth nozzle of the second swath to be printed. If the bottom of the previous swath is located exactly between the nozzles, then the remaining stitch joint error will be in the range of ±0.5 pixels. It should be appreciated that the bottom of the previous swath might not be located exactly between the nozzles. As such, the resulting remaining stitch error can be a value different from ±0.5 pixels.

According to another exemplary embodiment of this invention shown in Fig. the nominal set of nozzles in the printhead used to print the second swath can be more than the number of nozzles designated to fire pixel data in the second swath. In this situation, the data in the printhead can be shifted in either an up or down direction to reduce, minimize or prevent stitch joint error.

Figure 4:
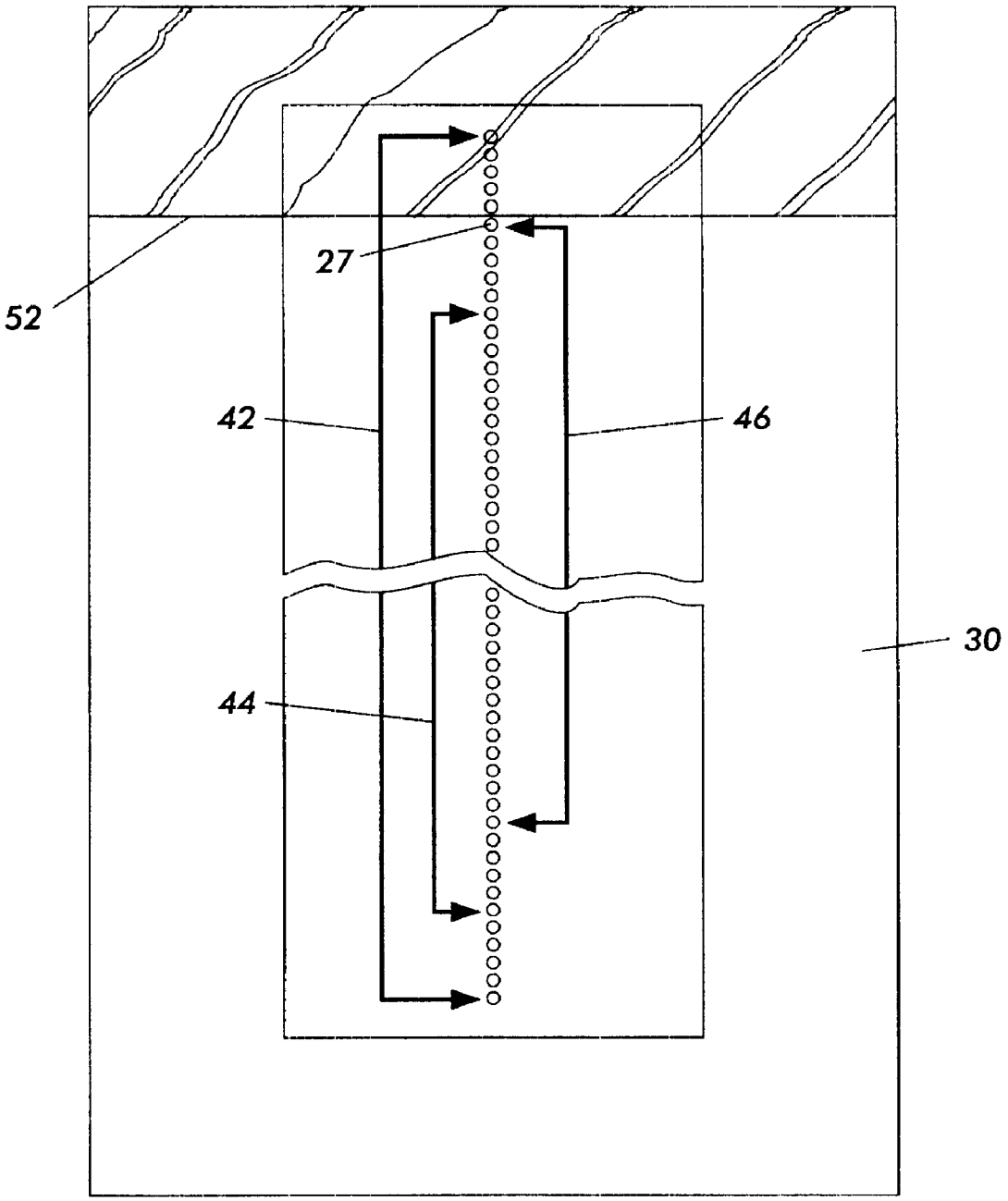
FIG. 4 shows another exemplary embodiment of pixel data fired from the next swath.

The exemplary embodiment of FIG. 4 includes nozzles which are not originally designated to fire pixel data located on either side of the nozzles 44 which are designated to fire pixel data. If the data in the printhead is shifted up to mask the stitch error, then there can be more nozzles at the bottom of the printhead which will not fire pixel data. Alternatively, if the data in the printhead is shifted down to mask the stitch error, there can be more nozzles at the top of the printhead which will not fire pixel data. Of course, it should be understood that the nozzles which are originally designated to fire pixel data, according to the exemplary embodiment of FIG. 4, can be any designated set of nozzles which allows for movement of the data in an up or down direction in the printhead.

In FIG. 4, the nominal set of nozzles 42 used to print the second swath is the number of nozzles of the printhead which are available to fire pixel data. However, according to the embodiment of FIG. 4, not all of the nominal set of nozzles 42 are originally designated to fire pixel data. Accordingly, there is a set of nozzles 44 which are designated to fire pixel data. This set of nozzles 44 contains the pixel data to be fired in the second swath and is located between the first and last nozzle of the nominal set of nozzles 42. According to the exemplary embodiment of FIG. 4, having the designated set of nozzles 44 located in between the nominal set of nozzles 42, allows the controller 35 to shift the data in the printhead in either direction, when a stitch joint error is detected, allowing for the stitch joint error to be reduced, minimized or prevented.

As discussed above, when the controller 35 determines that a stitch joint error will occur, the data is shifted in the printhead to mask the stitch joint error. However, according to the exemplary embodiment shown in FIG. 4, the data is fired from a different set of nozzles 46 from the set of nozzles originally designated to fire the pixels 44. As shown in FIG. 4, for example, the controller 35 determines that in order to reduce the stitch joint error, the pixel data should be shifted five nozzles. That is, the nozzles originally designated to fire pixel data 44 will be shifted in the upward direction. Originally, nozzle 11 was designated to be the uppermost nozzle firing pixel image data. However, after the pixel data has been shifted in the printhead, the sixth nozzle will be the uppermost nozzle to fire the pixel data. Correspondingly, the last five nozzles of the nozzles 44 originally designated to fire pixel data, will not fire pixel data because the data has been shifted upward five nozzles. Additionally, nozzles 6–10, which were not nozzles 44 originally designated to fire pixel data, will now be used and a part of the nozzles 46 used to fire pixel image data.

As discussed previously, it should be understood that the pixel data can also be shifted downward to reduce the stitch joint error because the nozzles 44 originally designated to fire pixel data are located in between the nominal set of nozzles 42. It should also be appreciated that the amount of shifting of the image data within the printhead can be any number of nozzles.

Figure 5:
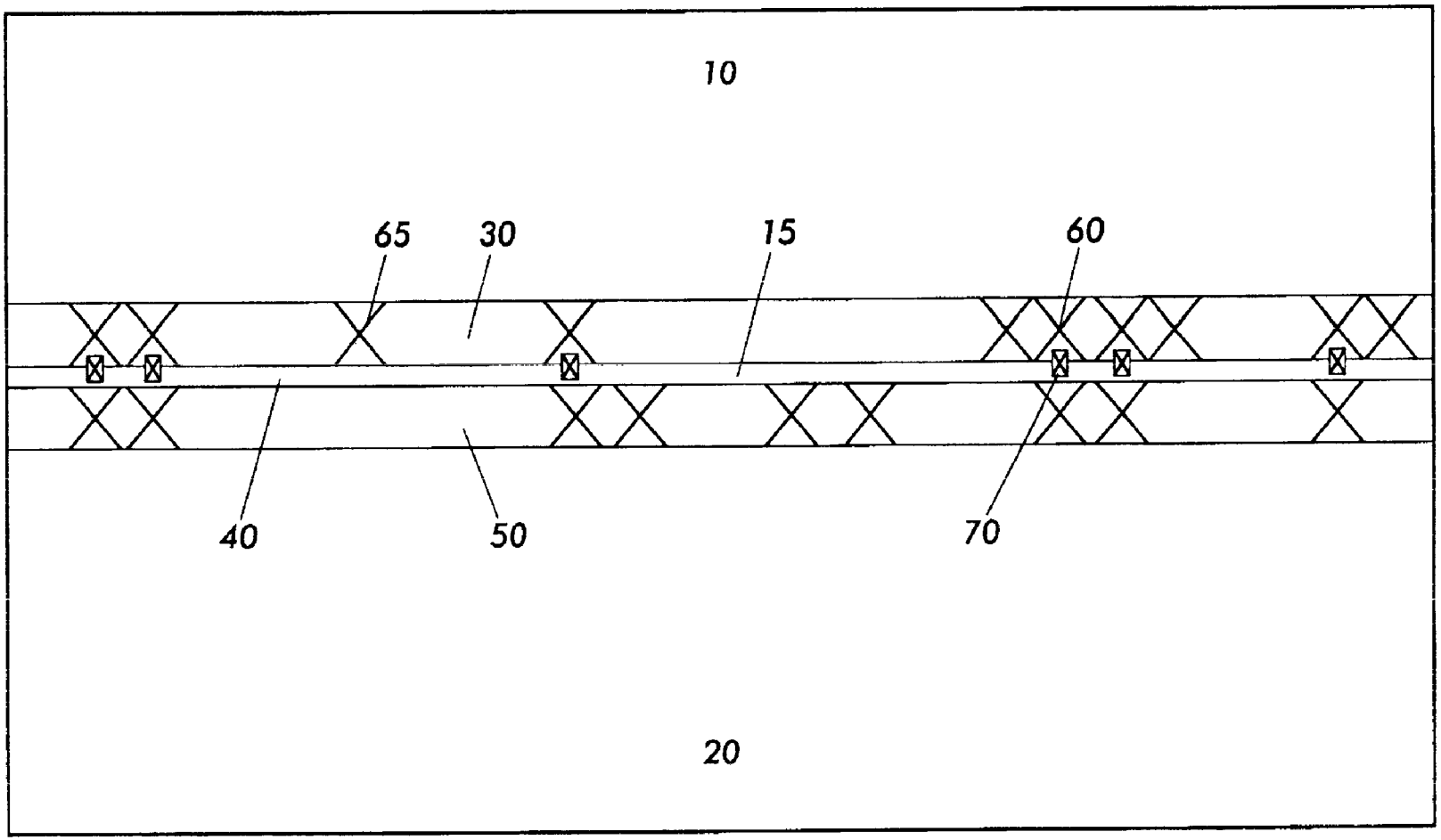
FIG. 5 shows a first exemplary embodiment for reducing a stitch joint error by showing the location of the fill pixels with respect to the position of the raster lines of the adjacent swaths.

FIG. 5 shows the situation where there is a stitch error that is in the range of ½ pixel. Thus, the first nozzle fired in the second swath 2 is mispositioned from the last fired nozzle of the first swath 1 by a pixel margin 15 that is at most 0.5 pixel on either side of the bottom edge 52 of the first swath 1. If printed even after shifting the relative position of the image data to the nozzles of the printhead to compensate for including advancing the sheet of recording medium, a stitch error would still be formed in the printed image.

That is, in various exemplary embodiments, in addition to shifting the data and firing the information set to be printed, the controller 20 will also fire a line of pixels from the nozzle prior to and immediately adjacent to the first-fired nozzle. In the example illustrated in FIG. 3, the controller 20 will fire a pixel from the fourth or fifth nozzle which is immediately adjacent and prior to the fifth or sixth nozzle used to fire the first line of pixels of the next swath. The line of pixels fired from the nozzle prior to and immediately adjacent the first nozzle to be fired, are called fill pixels 70.

The purpose of a fill pixel 70 is to bridge the gap between a printed pixel the last fired nozzle of swath 1 and a corresponding adjacent printer pixel that will be formed when the first line of pixels is formed by the nozzle that will be used for the first line of pixels for the second swath 2. As shown in the exemplary embodiment illustrated in FIG. 5, a fill pixel 70 is fired from the fourth or fifth nozzle resulting in the masking of the ½ pixel gap between the first and second swaths, thus further reducing the perception of the stitch joint error.

According to this exemplary embodiment, to reduce the effects of the stitch spacing, the fill pixels 70 are produced in a space between the first swath 1 and the second swath 2. The fill pixels 70 bridge the gap between adjacent pixels of the first swath 1 and the adjacent pixels to be fired in the second swath 2 as determined by the controller 20. The fill pixels 70 create a printed image having more uniform continuity and density.

In various exemplary embodiments, the fill pixels 70 are not produced for all of the pixels located in the last raster line 30 of the first swath 1. Instead, the fill pixels 70 are produced when a printed pixel 60 is located in the same position in both the first swath 1 and the second swath 2. Accordingly, as shown in FIG. 5, a fill pixel 70 is located between the printed pixel 60 of the first swath 1 and the printed pixel 60 of the second swath 2 which is located in the same position. A fill pixel 70 is not located below the printed pixel 65 because there is no corresponding printed pixel printed in the corresponding location in the second swath 2. However, it should be appreciated that a fill pixel 70 can be generated for any number of printed pixels of the first swath even if there will not be an adjacent printed pixel in the second swath.

It should be appreciated that the fill pixels 70 do not have to be directly in the center of the fill pixel raster line 40, nor do the fill pixels 70 have to be directly between the adjacent printed pixels 60 of the first swath 1 and the second swath 2. However, the fill pixels 70 should be located in the fill pixel raster line 40 within the region between the two printed pixels. The situation of FIG. 5 thus illustrates one desirable position for the fill pixels 70.

In various other exemplary embodiments, for a pixel error of 0.5 pixel, the fill pixels 70 are of a ½ smaller size or are ½ less dense than the corresponding printed pixels 60. Having the fill pixels 70 at a reduced size or density lessens the effect of overlapping of the fill pixel 70 and the printed pixels 60, which could create a darker image upon printing and/or could overload the fluid receiving substrate with too much fluid. It should be appreciated that for any size pixel error, the fill pixels 70 can be of any arbitrary size. Accordingly, the fill pixel 70 can be larger, the same size as, or smaller than the printed pixels 60.

In the exemplary embodiment illustrated in FIG. 5, the second swath 2 is mispositioned by 0.5 pixel from the first swath 1. Accordingly, fill pixels 70 are located in the fill pixel raster line 40 to reduced the stitch joint error. In addition to reducing the appearance of the stitch joint error, because a 0.5-sized pixel is added to the image, the image is lengthened by 0.5 pixel. It should be appreciated that the image is lengthened or shortened by approximately the size of the stitch joint error, and thus the size of the fill pixels 70 located in the fill pixel raster line 40 between the printed pixels 60 of the last raster line 30 of the first swath 1 and the first raster line 50 of the second swath 2.

According to another exemplary embodiment of the invention, the pixels created in the region between the last raster line of the first swath and the first raster line of the next swath, can be a duplicate line of either the last raster line of the first swath or the first raster line of the next swath. The duplicate line is a reprinted line of the same pixels in either the last raster line of the first swath or first raster line of the next swath. For example, if duplicating the last raster line of the first swath, the pixels printed in the region between the last raster line of the first swath and the first raster line of the next swath will be the same pixels printed in the last raster line of the first swath. It should be appreciated that the size and/or density of the duplicated line can be changed similar to changing the size and/or density of the fill pixels 70 discussed above.

Figure 6:
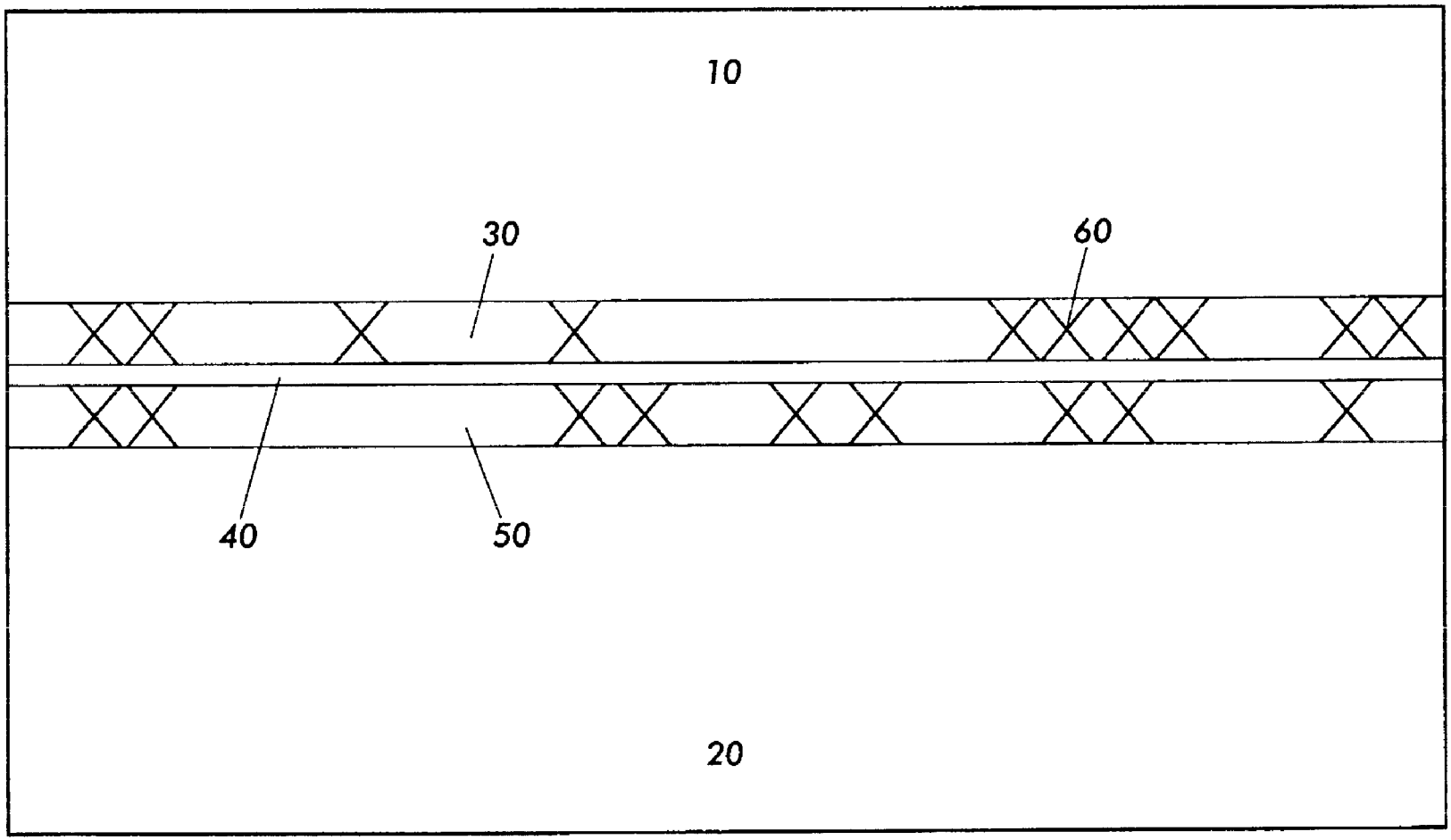
FIG. 6 is another exemplary embodiment of a stitch joint error.

FIG. 6 illustrates another exemplary embodiment of the invention. In FIG. 6, the size of the stitch joint error between the last raster line 30 of the first swath 1 and the first raster line 50 of the second swath 2 is a 0.25 of a pixel.

It should be appreciated that, in various exemplary embodiments, when the size of the stitch joint error is ±0.25 pixel or less, the last raster line 30 of the first swath 1 and the first raster line 50 of the second swath 2 are considered to be located in close proximity. Accordingly, in such exemplary embodiments, it might not be desirable for the user to produce a fill pixel 70 in the fill pixel raster line 40, to avoid an undesirably darker image in the area of the printed pixels 60. Accordingly, in this exemplary embodiment, the controller 20 can be designed to determine a pixel error below which using the fill pixels 70 in the fill pixel raster line 40 will not be required.

In various exemplary embodiments, if a fill pixel 70 is desired, a fill pixel 70 of ¼ size or ¼ density is produced in the fill pixel raster line 40 between adjacent printed pixels 60 of the last raster line 30 and the first raster line 50. Of course, for the reasons outlined above, the image will be elongated by a 0.25 of a pixel length.

Figure 7:
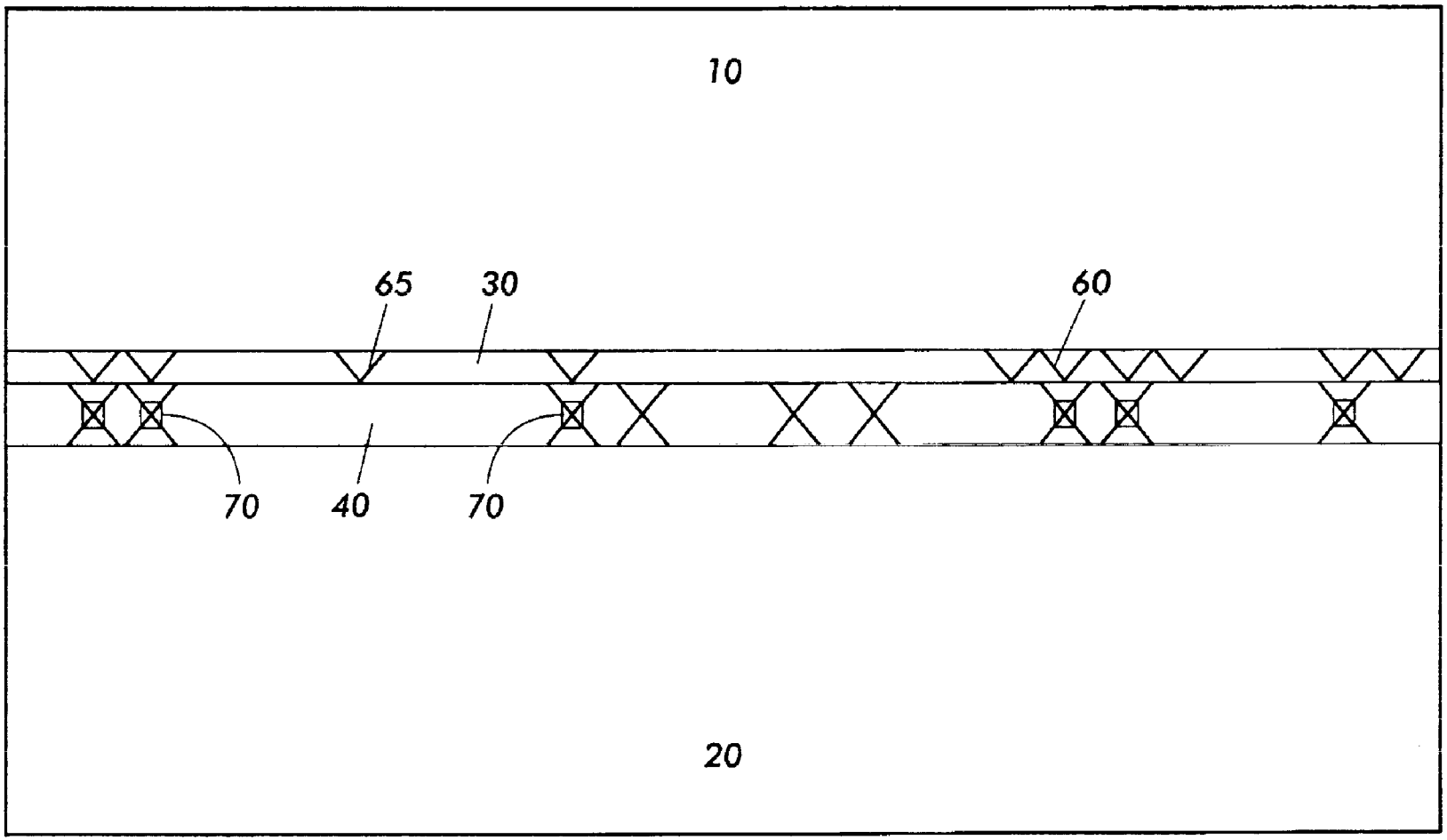
FIG. 7 shows a second exemplary embodiment for reducing a stitch joint error by showing the location of the fill pixels with respect to the position of the raster lines of the adjacent swaths.

FIG. 7 illustrates another exemplary embodiment of the residual or remaining stitch joint error according to this invention. In FIG. 7, there is a negative 0.5 pixel error between raster 30 of swath 1 and raster 50 of swath 2. That is, in contrast to the situations illustrated in FIGS. 3 and 4, where the first raster line 50 of the second swath was spaced away from the last raster line 30 to obtain a maximum stitch joint error of ±0.5 pixel, in this case, to limit the stitch joint error to ±0.5 pixel, the second swath 2 overlaps the first swath 1. In particular, as shown in FIG. 7, there is an overlap of the last raster line 30 of the first swath 1 and the first raster line 50 of the second swath 2 of at most 0.5 pixel. This situation results in the printed image having areas of dark densities corresponding to the overlapping pixels and areas of light densities where there is no overlap. This situation produces inconsistent image quality and density, and is undesirable.

In various exemplary embodiments, the printed pixels of the first raster line 50 of the second swath 2, which overlap with printed pixels of the last raster line 30 of the first swath 1, are reduced in density. The reduced density pixels 70 lessen the effect of dark banding caused by an overlap of standard size and standard density pixels.

Thus, as shown in FIG. 7, the reduced density pixels 70 of the first raster line 50 of the second swath 2 are reduced in density inversely proportional to the amount of overlap. However, it should be appreciated that the reduced density pixels 70 can be reduced by any amount which will reduce the effects of dark banding. Of course, for the reasons outlined above, the printed image with an overlap between the first and second swaths 1 and 2, a negative stitch error, such as a 0.5 pixel error, will be foreshortened by approximately 0.5 of the pixel length.

Figure 8:
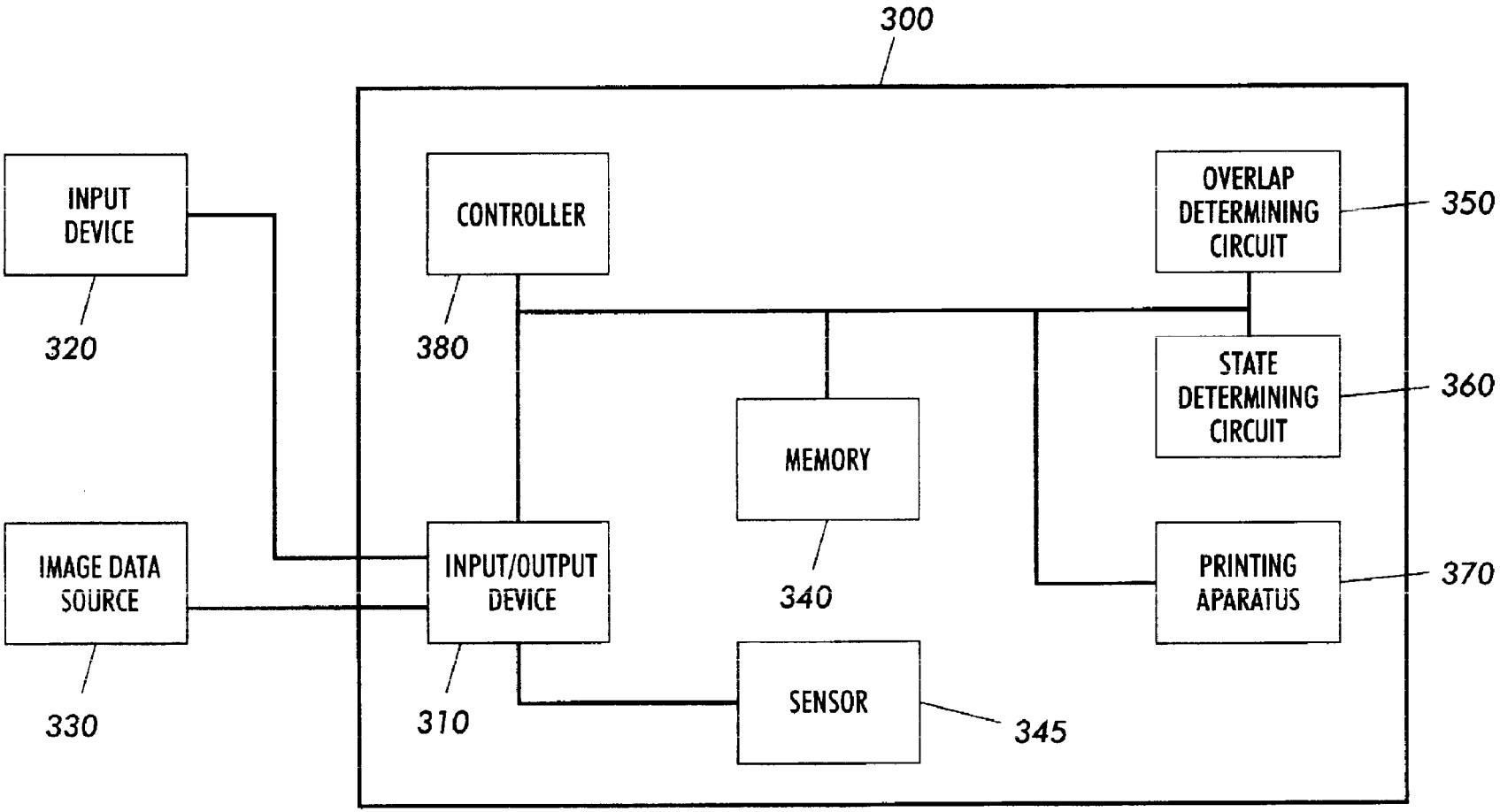
FIG. 8 is a functional block diagram of an exemplary embodiment according to the invention.

FIG. 8 is a functional block diagram of one exemplary embodiment of a printing device 300 incorporating the systems and methods of the invention. The printing device 300 has an input/output device 310 that connects the printing device 300 to an input device 320.

In general, the image data source 330 can be any one of a number of different sources, such as a scanner, a digital copier, a facsimile device that is suitable for generating electronic image data, or a device suitable for storing and/or transmitting electronic image data, such as a client or server of a network, or the Internet, and especially the World Wide Web. For example, the image data source 330 may be a scanner, or a data carrier such as a magnetic storage disk, CD-ROM or the like, or a host computer, that contains image data. Thus, the image data source 330 can be any known or later developed source that is capable of providing image data to the printing device 300 of this invention.

When the image data source 330 is a personal computer, the data line connecting the image data source 330 to the printing device 300 can be a direct link between the personal computer and the printing device 300. The data line can also be a local area network, a wide area network, the Internet, an intranet, or any other distributed processing and storage network. Moreover, the data line can also be a wireless link to the image data source 330. Accordingly, it should be appreciated that the image data source 330 can be connected using any known or later developed system that is capable of transmitting data from the image data source 330 to the printing device 300.

The printing device also includes, in addition to the input/output device 310, a sensor 345, a memory 340, an overlap determining circuit 350, a state determining circuit 360, and a controller 380, each communicating over a data/control bus. The overlap determining circuit 350 determines a degree of overlap of the next swath in order to select the most appropriate uppermost fired nozzle for the print head when printing the next swath. The state determining circuit 360 determines which state is most appropriate to produce the minimum stitch joint error (i.e., positive or negative stitch error). The printing apparatus 370 can include, for example, the print head.

In operation, according to one exemplary embodiment of FIG. 8, the input device 320 provides data to be printed and subsequently, a first swath of data is printed. A relative position between the recording medium and the printhead is crudely advanced to position the printhead relative to the recording medium for printing a next swath of the image data. The position of the fluid receiving medium is detected by the sensor 345 and the relative position of the recording medium and the printhead is determined based on the detected position of the recording medium.

After the relative position is determined, the controller 380 determines whether a stitch joint error will occur between the first and next swaths. If a stitch joint error will occur, the relative position of the raster lines of the next swath is shifted within the printhead to reduce the stitch joint error within a predetermined or dynamically determined maximum positive or negative value for the remaining or residual stitch joint error. In various exemplary embodiments, this predetermined or dynamically determined maximum error is ±0.5 pixel, but any useful values can be used as the predetermined maximum positive and negative values, such as 0 pixel and 1 pixel as the negative and positive values.

After the raster lines are shifted in the printhead, the overlapping determining circuit 350 determines, based on the value of the remaining or residual stitch joint error, whether the first swath and the second swath overlap. If an overlap is determined, the first raster line of the second swath is altered to reduce those printed pixels in that raster line that overlap printed pixels in the last raster line of the first swath. Then the next swath is printed.

However, if the overlap determining circuit determines there will be no overlap, a fill pixel line is generated to print pixels between the adjacent printed pixels in the last raster line of the first swath and the first raster line of the next swath. Then, the next swath is printed.

It should be understood that each of the circuits shown in FIG. 8 can be implemented as portions of a suitably programmed general purpose computer. Alternatively, each of the circuits shown in FIG. 8 can be implemented as physically distinct hardware circuits within an ASIC, or using a FPGA, a PDL, a PLA or a PAL, or using discrete logic elements or discrete circuit elements. The particular form each of the circuits shown in FIG. 8 will take is a design choice and will be obvious and predicable to those skilled in the art.

Figure 9:
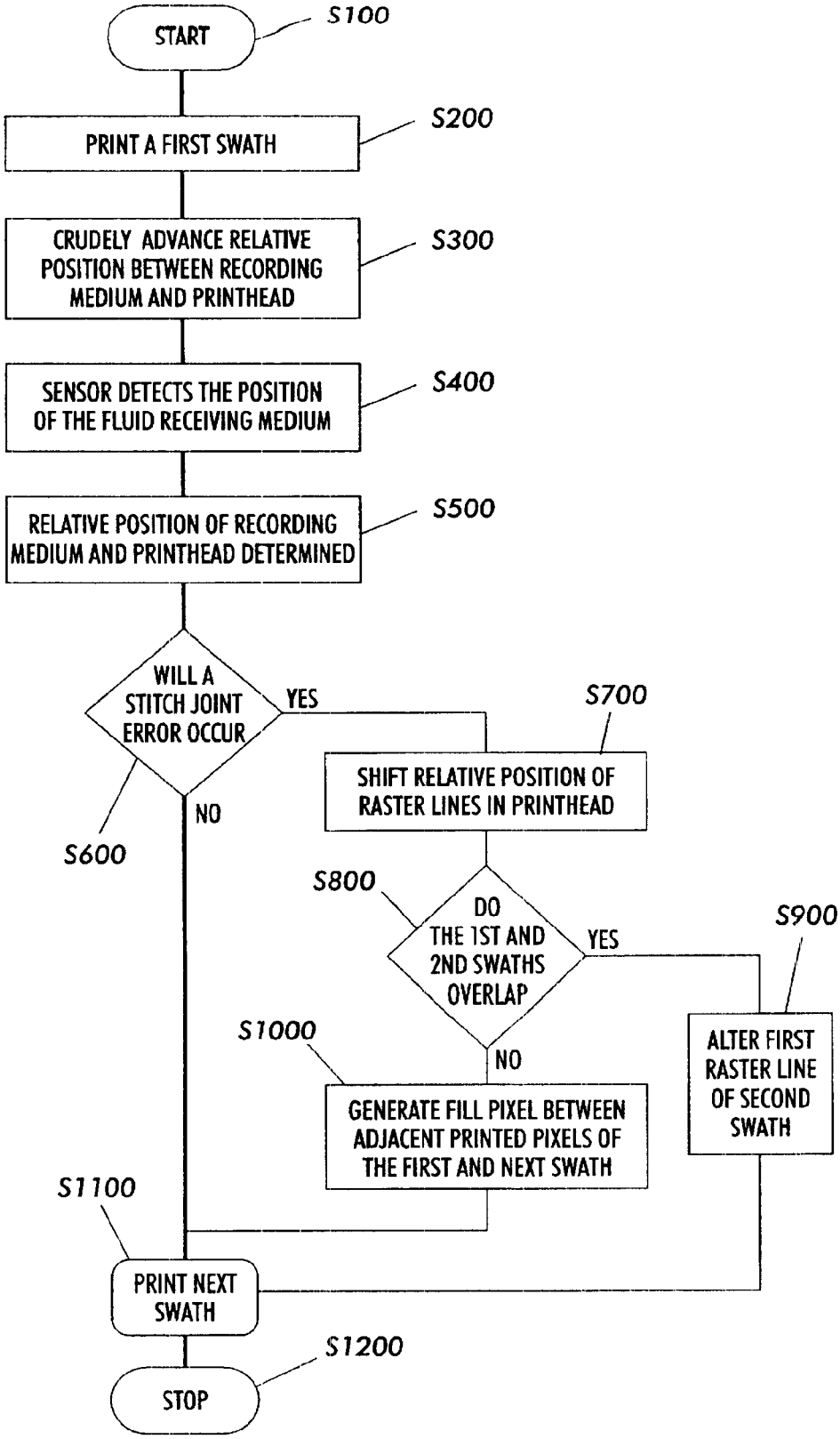
FIG. 9 is a flowchart outlining one exemplary embodiment of a method for reduced stitch error printing according to this invention.

FIG. 9 is a flowchart outlining one exemplary embodiment of a method of masking a stitch joint error according to this invention. Beginning in step S100, operation continues to step S200, where a first swath is printed. Then, in step S300, the relative position between the recording medium and the printhead is crudely advanced to position the printhead relative to the recording medium for printing a next swath of the image data. Next, in step S400, the position of the fluid receiving medium is detected by a sensor. Operation then continues to step S500.

In step S500, the relative position of the recording medium and the printhead is determined based on the detected position of the recording medium. Next, in step S600, a determination is made whether a stitch joint error will occur between the first and next swaths. If so, operation proceeds to step S700. Otherwise, if no stitch joint error will occur, operation jumps directly to step S1100. In step S700, the relative position of the raster lines of the next swath is shifted within the printhead to reduce the stitch joint error with a predetermined or dynamically determined maximum positive or negative value for the remaining or residual stitch joint error. In various exemplary embodiments, this predetermined or dynamically determined maximum error is ±0.5 pixel, but any useful values can be used as the predetermined maximum positive and negative values, such as 0 pixel and 1 pixel as the negative and positive values.

Then, in step S800, a determination is made, based on the value of the remaining or residual stitch joint error, whether the first swath and the second swath overlap. If so, operation continues to step S900. Otherwise, operation jumps to step S1000. In step S900, the first raster line of the second swath is altered, such as changing the size or density of the pixel image data, to change those printed pixels in that raster line that overlap pixels in the last raster line of the first swath. Operation then jumps to step S1100. In contrast, in step S1000, a fill pixel line is generated to print pixels between the adjacent pixels in the last raster line of the first swath and the first raster line of the next swath. Operation then continues to step S1100.

In step S1100, the next swath is printed. Operation then continues to step S1200, where the method ends.

While this invention has been described in conjunction with the exemplary embodiment outlined above, it is evident that many alternatives, modifications and variations will be apparent to those skilled in the art. Accordingly, the exemplary embodiment of the invention, as set forth above, is intended to be illustrative, not limiting. Various changes may be made without departing from the spirit and scope of the invention.

What is claimed is:

1. A method of reducing stitch joint error, comprising:

printing a first swath of image data on a fluid recording medium;

advancing the fluid recording medium to an advanced position;

detecting the advanced position of the fluid recording medium;

determining a relative position of the fluid recording medium with respect to a printhead;

determining if a stitch joint error will occur;

shifting, if a stitch joint error will occur, the image data in the printhead for a next swath to be printed; and firing the image data from one or more nozzles in the printhead to print the next swath of image data.

2. The method of claim 1, wherein advancing the fluid recording medium comprises crudely advancing the fluid recording medium.

3. The method of claim 1, wherein detecting the position of the fluid recording medium comprises detecting the position using a sensor.

4. The method of claim 3, wherein detecting the position of the fluid recording medium further comprises using a bi-directional linear incremental position sensor.

5. The method of claim 1, further comprising, maintaining, if a stitch joint error will not occur, a present position of the image data in the printhead.

6. The method of claim 1, wherein shifting the image data in the next swath, if a stitch joint error will occur, comprises shifting a relative position of at least one raster line of image data in the printhead of the next swath.

7. The method of claim 6, further comprising determining if an overlap exists between the first swath of image data and the next swath of image data.

8. The method of claim 7, further comprising altering a first raster line of image data of the next swath.

9. The method of claim 6, wherein shifting of the image data comprises shifting the image data in an upward direction.

10. The method of claim 6, wherein shifting of the image data comprises shifting the image data in an downward direction.

11. The method of claim 1, wherein shifting the image data comprises shifting a relative position of the printhead with respect to the fluid recording medium.

12. The method of claim 7, further comprising generating, if an overlap does not exist between the first swath and the next swath, at least one or more fill pixels between image data of the first swath and image data of the next swath.

13. The method of claim 12, wherein generating the at least one or more fill pixels comprises generating at least one or more fill pixels at a same or different density than the pixels of the first swath of image data and the pixels of the next swath of image data.

14. The method of claim 12, wherein generating the at least one or more fill pixels comprises generating at least one or more fill pixels at a same or different size than the pixels of the first swath of image data and the next swath of image data.

15. The method of claim 12, wherein generating the at least one or more fill pixels comprises altering the size of at least one of the pixels of the first swath of image data and the next swath of image data and the at least one or more fill pixels.

16. The method of claim 12, wherein generating the at least one or more fill pixels comprises altering the density of at least one of the pixels of the first swath of image data and the next swath of image data and the at least one or more fill pixels.

17. The method of claim 10, further comprising designating image data for each of the one or more nozzles of the printhead.

18. The method of claim 10, further comprising designating image data for less than all of the one or more nozzles of the printhead.

19. An stitch joint error reducing apparatus, comprising:

a printhead that prints a first swath of image data on a fluid recording medium;

a device for advancing the fluid recording medium;

a sensor that detects a position of the fluid recording medium; and a controller for determining a relative position of the fluid recording medium with respect to a printhead and determining if a stitch joint error will occur, wherein the controller shifts image data in the printhead if a stitch joint error will occur and prints a next swath of image data.

20. The apparatus of claim 19, wherein the rotational device crudely advances the position of the fluid recording medium.

21. The apparatus of claim 19, wherein the sensor is a bi-directional linear incremental position sensor.

22. The apparatus of claim 19, wherein the controller does not shift the image data in the printhead if a stitch joint error will not occur.

23. The apparatus of claim 19, wherein the controller detects if an overlap exists between the first swath and the next swath after the image data has been shifted in the printhead.

24. The apparatus of claim 23, wherein, for a determination that an overlap does not exist between the first swath and the next swath, the controller generates at least one or more fill pixels between adjacent pixels of the first swath and the next swath.

25. The apparatus of claim 24, wherein the at least one or more fill pixels is generated at the same or different density than the adjacent printed pixels.

26. The apparatus of claim 24, wherein the at least one or more fill pixels is generated at a same or different size.

27. The apparatus of claim 23, wherein, for a determination that an overlap exists between printed pixels of a last raster line of the first swath and a first raster line of the next swath, the controller alters pixels of the first raster line of the next swath.

28. The apparatus of claim 27, wherein altering the printed pixels comprises reducing the size of the printed pixels.

29. The apparatus of claim 27, wherein altering the printed pixel comprises reducing the density of the printed pixels.

30. The apparatus of claim 19, wherein the printhead fires image data from one or more nozzles in the printhead.

31. The apparatus of claim 30, wherein pixel data is designated for each of the one or more nozzles of the printhead.

32. The apparatus of claim 30, wherein pixel data is designated for less than all of the one or more nozzles in the printhead.

33. The apparatus of claim 19, wherein the controller shifts the image data in an upward direction.

34. The apparatus of claim 19, wherein the controller shifts the image data in a downward direction.

* * * * *